United States Patent [19]

Jacobsen

[11] 4,179,874

[45] Dec. 25, 1979

[54] METHOD AND APPARATUS FOR THE SPINNING OF YARN

[76] Inventor: Alan N. Jacobsen, 14 Raheen Dr., Kew, Victoria, Australia

[21] Appl. No.: 953,345

[22] Filed: Oct. 23, 1978

[30] Foreign Application Priority Data

Oct. 21, 1977 [AU] Australia ..... 2148/77

[51] Int. Cl.[2] ..... D01H 1/12

[52] U.S. Cl. ..... 57/58.89; 57/58.91

[58] Field of Search ..... 57/58.89–58.95

[56] References Cited

U.S. PATENT DOCUMENTS

| | | | |
|---|---|---|---|
| 3,688,487 | 9/1972 | Fukuta et al. | 57/58.91 X |
| 3,918,246 | 11/1975 | Bouhon | 57/58.91 |
| 3,978,646 | 9/1976 | Hoffmann et al. | 57/58.91 X |
| 4,044,537 | 8/1977 | Negishi et al. | 57/58.89 |
| 4,091,605 | 5/1978 | Jacobson | 57/58.89 |

*Primary Examiner*—Donald Watkins

*Attorney, Agent, or Firm*—Thompson, Birch, Gauthier & Samuels

[57] ABSTRACT

A method of spinning fibres to form a yarn wherein the fibres are condensed in an internal groove and a rotating annular member and the condensed fibres are peeled from the groove and passed between two surfaces of rotation co-axial with the annular member and rotating at different speeds so that the assembly of fibres peeled from the groove is caused to roll on its axis between the two surfaces of revolution as the assembly of fibres pass in an axial direction therebetween so that the fibres are twisted to form a yarn.

13 Claims, 5 Drawing Figures

METHOD AND APPARATUS FOR THE SPINNING OF YARN

Figure 1:
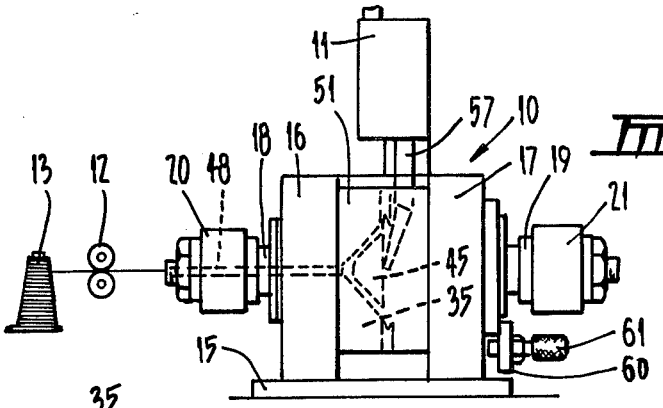

This invention relates to a method and apparatus for the spinning of textile yarn from natural, artificial or synthetic fibres.

Because of the well-known limitations of the familiar and highly developed Ring Spinning Systems, such as, the restricted package size, the restricted production rate and the high cost of frequent doffing; and in view of the technical difficulties, especially of yarn ballooning, the effect of windage on the fibres, which impede the use of increased ring-spindle speeds; study has been extended to other known principles and to the development of innovative departures from the ring-spinning system.

In order to obtain high production rates from existing spinning systems for production cost advantage, emphasis has been given to the provision of high spindle and rotor speeds. High mechanical speeds however involve costly power consumption and other negative commercial and technical aspects.

The known "Open end", "Break", or "Free fibre" spinning system, as it is variously known, has been utilized in the development of various spinning methods, mostly requiring the rotation of a twisting device imparting one turn in the forming yarn for each rotation of the device.

The most effective "Break", spinning system has been the "Drum" or "Rotor" type, and employs a rapidly rotated drum, at speeds up to 50,000 revolutions per minute. Apart from the drum speed, the rate of withdrawal of the forming yarn determines the number of turns per inch of yarn inserted by the rotating drum, whereas the input of fibres into the drum determines the count of the yarn. It is necessary, in the drum spinning, for the fibres to be built up layer by layer in the drum as the drum rotates, while the fibre-web is simultaneously being peeled off. Some fibres become trapped in the forming yarn out of turn, and inconvenient "bridging" of the fibres tends to occur causing areas of weakness in the yarn and/or a higher than desirable incidence of yarn breakage. Especially with the production of yarns of fine counts it is possible to deliver the required mass of fibres to the drum collector at relatively higher speeds than is possible for the drum system to supply twist for the formation of the yarn. Thus the speed and operation of the system is dependent upon the twisting capacity of the machine. The fibre input system, as well as the withdrawal and winding systems, have not been operable at or near maximum possible speeds owing to the limitations of the rate of twist insertion being kept down by restriction of drum speed.

The performance of the drum spinner is governed by the diameter of the drum which affects both the length of the fibres which may be spun, as well as the speed at which the drum can rotate and insert twist. High drum speeds necessary for the economy of production impose the necessity for the employment of a relatively small drum. This is due to the limitation of burst strength which can be exceeded by using a large diameter drum at the high speed required for twist insertion commensurate with a high yarn withdrawal rate. However a drum of relatively small diameter is not suitable for the spinning of fibres of relatively longer staple length.

At higher drum speeds there is also an occurrence of a greater incidence of fibre entanglement. At high drum speeds, air turbulence increases yarn breakage rates, and detracts from yarn quality. A large diameter drum operating at lower speed produces optimum yarn quality and enables fibres of longer length staple to be spun, but this combination adversely affects the economy of the production of "Open End/Drum" spinning as practised hitherto.

Another spinning system, known as "Self Twist" avoids the need for an open end in the fibre delivery system, whilst obtaining the advantages, as in open end spinning, of high production and large reception packages. This system involves the use of a pair of rollers through which the drafted fibre assembly is drawn, whilst the rollers reciprocate in an axial direction relative to each other. The reciprocating movement of the rollers, rolls the fibres so that twist is imparted to them. Because the movement between the rollers is reciprocatory, the direction of twist is reversed with each reciprocation of the rollers. Also, at the change of direction of the reciprocation, there is a short interval of time when the rollers are effectively stationary, and hence no twist is applied to the fibres during this interval. The length of this untwisted section is dependent upon the rate of the yarn withdrawal, and the speed of the reciprocation of the rollers.

The twist producted by the reciprocatory action of the rollers on the forming yarn is "false twist" i.e. the insertion of twist on the input side of the twisting mechanism is cancelled out, in the case of continuous twisting in a constant direction, on the egress side of the mechanism. The interval of zero twist separates the sections of opposing twists and so that twist is retained in the yarn so long as no undue tension is applied to the single end of yarn. Thus there are produced alternate sections of "S" and "Z" twist separated by sections of zero twist.

The yarn may disassemble at the point of weakness in the section of zero twist, on the application of tension such as in winding, were it not for the joining in staggered alignment, of two contiguously produced ends of yarn, thereby to form a two-fold yarn. The opposite twists of the two ends of yarn are so arranged in the withdrawal of each from the reciprocatory rollers, that they merge together, and form a bond, as each opposing twist tends to unwind against the other. The zero twist sections of the two merging yarn ends also are not permitted to coincide in the formation, as this would create a weak untwisted section in the doubled yarn, which would give rise to yarn breakage during the further processing. The above described method of inserting twist may be satisfactory where the fibre-length is relatively long; however with shorter fibre length staples, such as cotton, the untwisted sections which may exceed the length of a single fibre, thus represent an unacceptable weakness in the yarn.

It will also be appreciated that the sections of "S" and "Z" twists, and relatively untwisted sections, can present variables in other properties of the yarn, such as its dyeing characteristics, and also impose some limitations on the end-use applications of the yarn and subsequent products.

The above described known methods of spinning yarn are only examples of the many variations on the basic known process. Further information on current practices and development can be found in the book entitled "Spinning in the '70s" by P. R. Lord, Assistant Professor, School of Textiles, North Carolina State University; published by Merrow Publishing Co. Ltd. of Watford, Herts., England.

There has recently been proposed in my U.S. Pat. No. 4,091,605 a method and apparatus for spinning yarn wherein an assembly of staple fibres is delivered in a continuous stream onto a surface of revolution and drawn across said surface from one axial end thereof to the other axial end, and movement is effected between the assembly of fibres and said surface to cause the assembly of fibres to roll on its axis upon the surface whereby the fibres of the assembly are twisted together to form a yarn.

The movement between the assembly of fibres and the surface of revolution is achieved by rotating either or both about the axis of the surface. The assembly of fibres may roll on either an internal or external surface of revolution or may be rolled between two co-axial surfaces of revolution, one internal and one external.

In one arrangement the fibres are drafted by feeding a prepared sliver to a rotating toothed pinion and the drafted fibres are conveyed in an air stream to a venturi. The fibres are accelerated during passage through the venturi to effect further thinning of the fibre mass, to create the "break" necessary for open end spinning. The venturi delivers the thinned fibres to an axially orientated collector groove, where condensing of the fibres takes place as the fibres are being delivered continuously at a controlling rate to the groove. At this point the twisting "tail" of the already forming yarn picks up the condensed fibres from the axial collector groove to draw the fibres across the surface of revolution.

The degress of twist imparted to the forming yarn as it is drawn across the surface of revolution is dependent upon the diameter of the surface of revolution, the speed of rotation thereof, and the speed at which the forming yarn is drawn across the surface.

In such an apparatus where the surface of revolution is of 2" diameter, and the theoretical count of the yarn produced is 30 cc with a yarn diameter of 0.0065"; the theoretical number of insertable twists per revolution of the fibre assembly around the axis of the surface of revolution would be 315. Thus if the fibre assembly is rotated about the axis at 800 RPM the insertable twist per minute amounted to 252,000 turns. In practice the number of turns was less because of the slippage factor.

In view of the capability of my previously proposed method and apparatus to impart a high number of turns per minute to the fibres, it is accordingly possible to employ a high speed of withdrawal of the yarn and still retain the required turns per inch in the finished yarn to produce a quality yarn. It will therefore be appreciated that my previous invention permits high production rates without sacrifice in quality.

It is an object of the present invention to also provide a method and apparatus for spinning yarn, which will provide a uniform uni-directional twist at a relatively high production rate, employing the open end spinning technique without requiring unduly high mechanical speeds for twisting purposes, and without being subject to the limitations affecting drum spinning of the drum speed and drum diameter as before mentioned.

It is a further object of the present invention to provide a modification of the method and apparatus as disclosed in my previous U.S. Patent which will contribute to the quality and rate of yarn produced, and simplify the construction of the machine.

With this object in view there is provided according to the present invention, a method of spinning yarn comprising collecting fibres in an internal annular recess in a member rotating about the axis of the annular recess, peeling a continuous assembly of fibres from said recess and delivering said assembly to one axial end of a surface of revolution co-axial with the annular surface drawing said assembly of fibres across said surface of revolution from said one axial end to the opposite axial end while simultaneously effecting movement between the assembly of fibres and said surface of revolution to cause the assembly of fibres to roll upon the surface of revolution whereby the fibres of the assembly are twisted together to form a yarn.

Conveniently the surface of revolution is rotated about the axis thereof at a speed and/or in a direction different to that of the recessed member to cause the assembly of fibres to roll on the surface of revolution. Preferably the assembly of fibres is drawn between the said surface of revolution and co-axial further surface of revolution which may conveniently rotate with the recessed member. These two surfaces of revolution are spaced apart in the radial direction so that the assembly of fibres engages each surface as it is drawn therebetween. The difference in speed and/or direction of rotation of the two surfaces of rotation cause the assembly of fibres to roll therebetween about the axis of the assembly thus twisting the fibres to form a yarn.

Apparatus suitable for spinning yarn, preferably in accordance with the above method, may comprise a member mounted for rotation and having a fibre collecting annular recess in an internal face thereof co-axial with the axis of rotation, means to deliver fibres into said annular recess so that they are collected therein by the rotation of the member, a surface of revolution co-axial with the recess and displaced axially therefrom so that an assembly of fibres withdrawn from the annular recess may be delivered to one axial end of the surface and be drawn in the axial direction across said surface to the other axial end, and means to cause the assembly of fibres to roll on said surface of revolution while being drawn thereacross to twist the fibres together to form a yarn.

Preferably the member in which the recess is formed is rotated at a speed that will cause the fibre to collect and condense in the recess. The annular recess functions in a manner similar to the drum in the known drum spinning process of producing yarn. Conveniently the surface of revolution is formed on a further member mounted for rotation on the axis of the surface and co-axial with the recessed member. The further member is rotated at a different speed and/or direction to the recessed member, and the surface of rotation has a friction characteristic which will cause the assembly of fibres to roll thereon rather than slip, or grip thereon. The required frictional characteristics may be provided by coating or otherwise applying suitable friction material to a metal or other base member.

In one arrangement the recessed member is provided with an internal surface of revolution in the same diametral plane as the surface on the further member which is an external surface. The two surfaces of revolution are radially spaced so that the assembly of fibres can pass therebetween in contact with both surfaces. These two members rotate at different speeds and cause the assembly of fibres to roll on the surfaces to achieve the desired twist.

Although the recessed member functions in a manner similar to the drum of a drum spinner, the speed of rotation of the recessed member is not the factor determining the rate of twist of the yarn, as is the situation in a drum spinner. The recessed member must rotate at a speed sufficient to collect and condense the fibres in the recess, but the rate of twist is dependent on the respective diameters of the assembly of fibres and the surface of revolution and the speed of the latter.

The invention will be more readily understood from the following description of an apparatus for spinning fibres in accordance with the present invention and as illustrated in the accompanying drawings.

Figure 4:
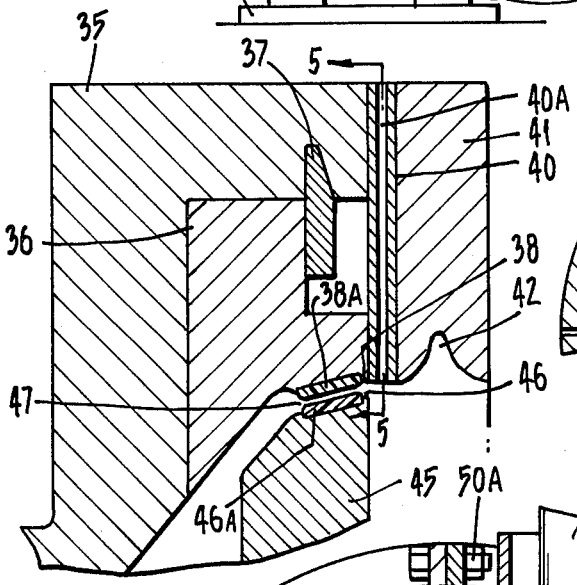
Figure 5:
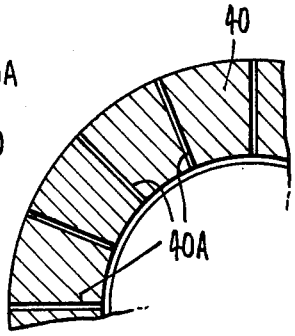
Figure 3:
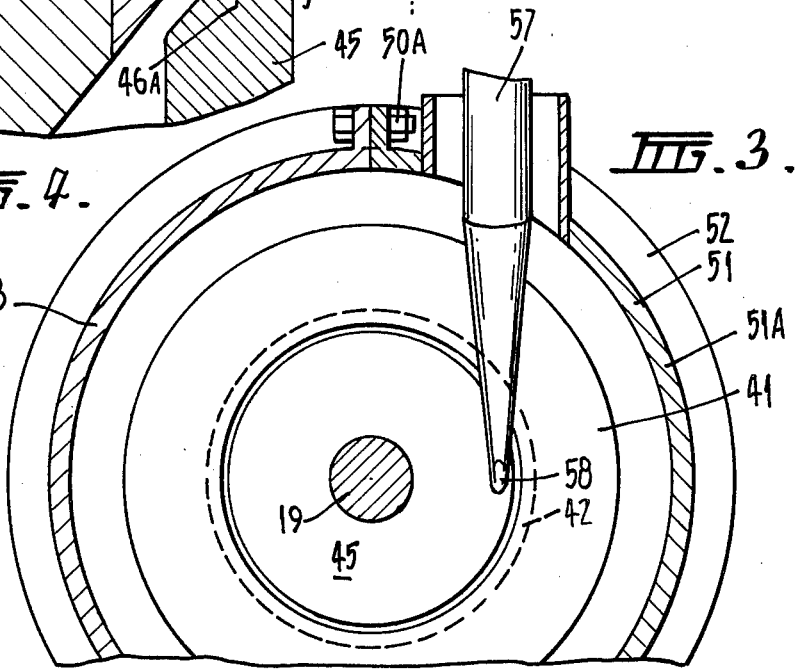
Figure 2:
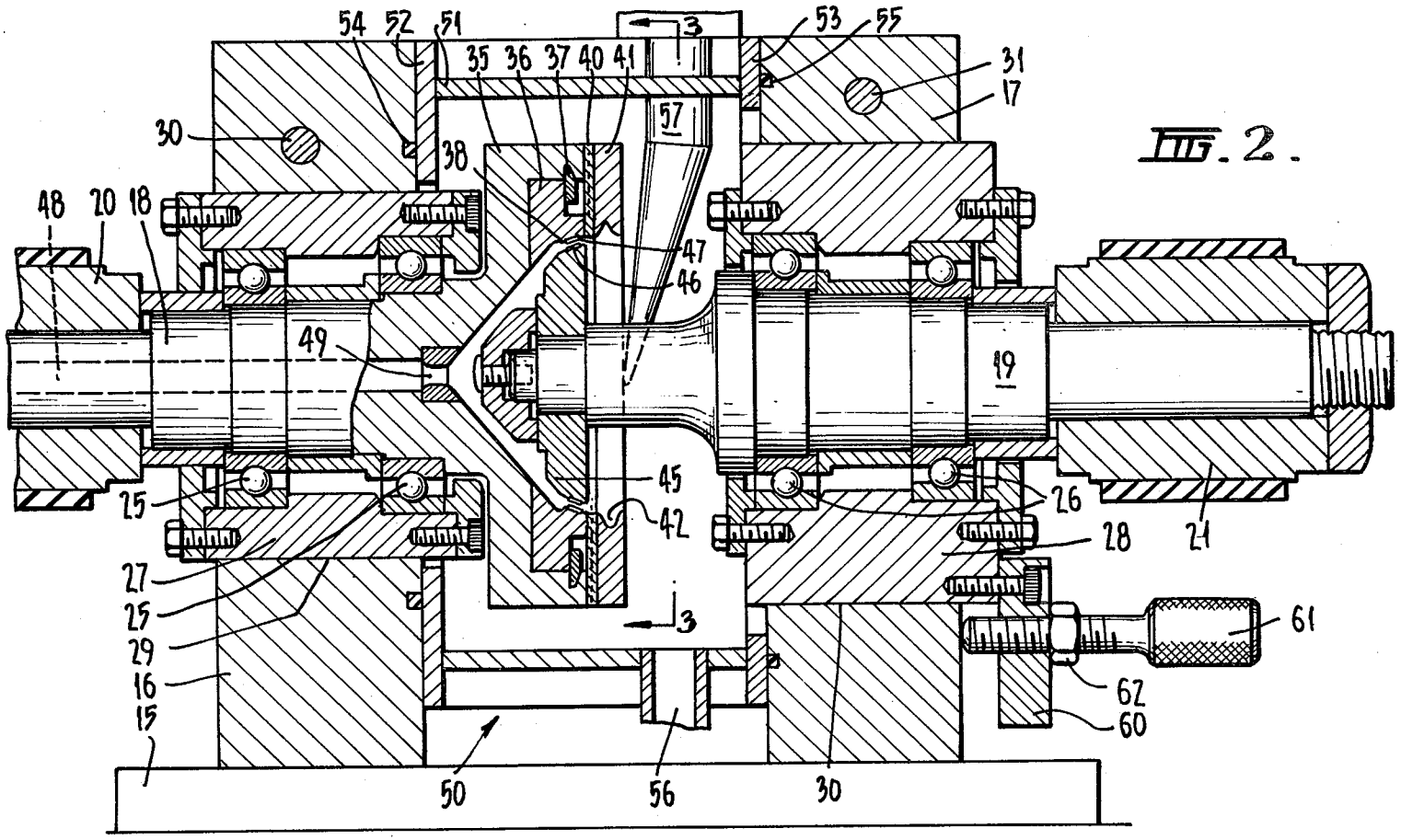

In the drawings:

FIG. 1 is a schematic representation of the method and apparatus required to carry out the invention, FIG. 2 is a longitudinal sectional view of the spinning apparatus, FIG. 3 is a sectional view in part along the line 3—3 in FIG. 2, FIG. 4 is an enlarged sectional view to illustrate the fibre collection groove and passage formed by the surfaces of revolution, and FIG. 5 is a sectional view in part along the line 5—5 in FIG. 4.

Referring now to the drawings, FIG. 1 shows in a diagrammatic manner one practical arrangement of the spinning apparatus 10, and the associated equipment of known construction, used in conjunction with the spinning apparatus. The drafting device 11 is of any suitable known construction, and delivers drafted staple fibres to the spinning apparatus 10. The spun yarn is withdrawn from the spinning apparatus 10 by the take-up rollers 12 and subsequently wound onto a package 13.

The spinning apparatus 10 comprises a base 15 with two spaced upright pedestals 16 and 17 mounted thereon. Respective shafts 18 and 19 are journalled in the pedestals 16 and 17 and carry respective drive pulleys 20 and 21.

Referring now to FIG. 2, the shafts 18 and 19 are rotatably mounted on respective pairs of bearings 25 and 26 mounted in respective bearing carriers 27 and 28. The bearing carriers 27 and 28 are received in aligned bores 29 and 30 in the pedestals 16 and 17 respectively. The portion of each pedestal above the respective bores is split with respective clamp bolts 31 and 32 extending through that portion of the pedestal to clamp the bearing carriers 27 and 28 against rotation and axial movement within the pedestals.

The shaft 18 is formed with an annular flange portion 35 located between the pedestals 16 and 17. The flange portion 35 has non-rotatably mounted therein the ring 36 secured in position by the circlip 37. The ring 36 is provided with an internal annular surface 38 slightly inclined to the axis of the ring, the surface of which will be explained in greater detail later in this specification.

Attached co-axially to the flange portion 35 are an annular plate 40 and a collector member 41. The internal diameter of the plate 40 is approximately the same as the diameter of the adjacent end of the inclined face 38. A plurality of spaced radial apertures 40A extend through the plate 40 in a radial direction, from the internal to the external peripheral face, to provide air passages.

The collector member 41 is provided, on the internal surface, with a continuous groove 42 of generally V-shaped cross-section with the apex of the V radially outermost. The groove 42 acts as a collector groove for fibres delivered from the drafting device 11 as will be explained hereinafter.

The flange member 45 is attached to the shaft 19 to rotate therewith, and is located substantially concentric with the inclined surface 38 of the ring 36. The flange member 45 has an external peripheral surface 46 substantially parallel to the surface 38 on the ring 36, so as to define therebetween an annular passage 47. This part of the apparatus will be described in further detail hereinafter.

The bearing carrier 28 has an arm 60 projecting therefrom in which is threadably engaged the adjustment screw 61 carrying the lock nut 62. The adjusting screw 61 abuts the pedestal 17 whereby upon loosening the clamp nut 31 the position of the bearing carrier 28 relative to the pedestal 37 may be varied by operation of the screw 61, and resulting in an adjustment of the axial relationship of the surfaces 38 and 46, which in turn varies the width of the annular passage 47. The adjustment of the width of the passage 47 is relevant to the count of the yarn being produced by the spinning apparatus, as will hereinafter be described.

The shaft 18 has an axial passage 48 extending through the length thereof with a guide bush 49 at the inner end thereof where the yarn enters the passage 48 from the passage 47. The yarn passes from the passage 48 through the take-up rollers 12 to the package 13.

Surrounding the flange portion 35 and ring 41 assembly, is a housing 50 which forms with the pedestals 16 and 17, a substantially air tight enclosure. The housing 50 is formed of a peripheral section 51 comprising two semi-circular elements 51*a* and 51*b* secured together by nuts and bolts 50*a*, and respective end annular discs 52 and 53. The annular discs and the peripheral section are held in pressure engagement between and by the pedestals 16 and 17, with sealing rings 54 and 55 between the respective pedestals and the annular discs to form a substantially air tight enclosure. The duct 56 leads from this enclosure and is connectable to a suction source, whilst the duct 57 leads from the drafting device 11 into the enclosure. The delivery end 58 of the duct 57 directs the fibres in a substantially tangential relationship into the groove 42 in the ring 41.

The shafts 18 and 19 are driven through the pulleys 20 and 21 by independent motors, or from a single motor through respective transmissions, so that the speed of each shaft may be independently selected. The speeds of the respective shafts are selected so that the peripheral speeds of the surfaces 38 and 46 are different. Arising from this difference in peripheral speed an assembly of fibres drawn through the passage 47 in contact with the surfaces 38 and 46 will be caused to roll on its axis along the surface having the lower peripheral speed. This rolling of the fibres applies twist thereto to produce the yarn.

As shown in greater detail in FIG. 4 of the drawings, insert rings 38*a* and 46*a* are provided in the surfaces 38 and 46. These insert rings are made of a material having the required frictional characteristics to achieve the rolling of the assembly of fibres with a minimal degree of slip between the fibres and the rings. Elastomer is one material suitable for this purpose.

As previously indicated by operation of the adjustment screw 51, the flange 45 may be moved in an axial direction relative to the ring 36 to either increase or decrease the distance between the insert rings 38*a* and 46*a* in accordance with the diameter of the yarn to be produced. The diameter of the yarn is of course also related to the rate of withdrawal of fibres from the groove 42, and the distance between insert rings 38*a* and 46*a* must be adjusted to accommodate the fibres passing therethrough while in contact with both rings in order to roll the fibres and form the yarn of the required count.

The staple fibres developed in the drafting device 11 are pneumatically conveyed through the duct 57 and are discharged in a generally tangential direction into the internal annular groove 42. The air flow to convey the staple fibres is derived by the application of the suction to the duct 56 which draws air into the housing 50 via the duct 57 and the drafting device 11. In order to control the flow of air in the vicinity of the groove 42 the diameter and number of the apertures 40*a* in the plate 40 are such that substantially all of the air discharged from the duct 57 may be withdrawn through these apertures.

The fibres delivered to the groove 42 form a substantially uniform layer therein and are subject to a condensing or compacting by the centrifical force generated by the rotation of the ring 41. The speed of rotation of the ring is therefore selected in accordance with the degree of condensing of the fibres required.

An assembly of fibres is peeled from the layer of fibres in the groove 42 and drawn through the passage 47. The peeling off of the assembly of fibres is initiated by the use of a seed yarn similar to the technique practised in drum spinning. The seed yarn extends from the groove 42 through the passage 47 and the guide 48 to the take-up rollers 12.

It will be appreciated that the apparatus as disclosed above is considerably simpler in construction than that disclosed in my previous patent and yet it has the prime advantage of my previous invention in that the twisting of the assembly of fibres is achieved by rolling the assembly on a surface of revolution simultaneous with the assembly being drawn in the axial direction across the surface. The additional advantage of the present construction is in the use of the collector member 41 in which the staple fibres are initially condensed prior to being drawn across the surface of rotation. The use of this collector member with the internal collector groove 42 avoids the necessity of having to synchronise by a mechanical drive, the movement of the assembly of fibres about the axis of the surface of rotation with the movement of the point of delivery of the assembly of fibres onto the surface of rotation.

As an example of the production rate which can be achieved with the present invention with relatively slow rotational speeds; with the ring 36 rotating in a clockwise direction at 13,250 r.p.m. and the flange 45 rotating in the same direction at 14,000 r.p.m. and the mean diameter of the passage 47 being 3 inches and the nominal diameter of the yarn 0.005 inches; yarn having approximately 25 twists per inch can be produced at a rate of 800 feet per minute.

I claim:

1. A method of spinning yarn comprising collecting fibres in an internal annular recess in a member rotating about the axis of the member, peeling a continuous assembly of fibres from said recess and delivering the assembly of fibres in a continuous stream to one axial end of a surface of revolution, drawing the assembly of fibres across said surface from said one axial end to an opposite axial end while simultaneously effecting movement between the assembly of fibres and said surface to cause the assembly of fibres to roll upon the surface whereby the fibres of the assembly are twisted together to form a yarn.

2. A method of spinning yarn as claimed in claim 1 wherein the surface of revolution is rotated about the axis thereof to effect said movement between the surface and the assembly of fibres.

3. A method of spinning yarn comprising collecting fibres in an internal annular recess in a member rotating about the axis of the member, peeling a continuous assembly of fibres from said recess, and delivering the assembly of fibres in a continuous stream into one axial end of an annular passage defined by two concentric surfaces of revolution spaced radially from one another, drawing the assembly of fibres through said passage from said one axial end to the other axial end, while simultaneously effecting movement between said assembly of fibres and at least one of said surfaces to cause the assembly of fibres to roll upon at least said one surface whereby the fibres are twisted together to form a yarn.

4. A method as claimed in claim 3 wherein the assembly of fibres is in contact with each said surface of revolution whilst being drawn through the passage, and the respective surfaces of revolution are rotating at different rotational speeds to cause the assembly of fibres to roll.

5. A method as claimed in claim 4 wherein the recessed member and one of the surfaces of revolution rotate at the same rotational speed.

6. A method as claimed in claims 1 or 3 wherein the fibres are pneumatically conveyed to the annular recess, and delivered in a substantially tangential relation thereto.

7. Apparatus for spinning yarn comprising a member mounted for rotation and having a fibre collecting annular recess in an internal face thereof co-axial with the axis of rotation, means to deliver fibres into said annular recess so that they are collected therein by the rotation of the member, a surface of revolution co-axial with the recess and displaced axially therefrom so that an assembly of fibres withdrawn from the annular recess may be delivered to one axial end of the surface and drawn in the axial direction across said surface to the other axial end, and means to cause the assembly of fibres to roll on said surface of revolution while being drawn thereacross to twist the fibres together to form a yarn.

8. Apparatus as claimed in claim 7 wherein the surface of revolution is an internal surface and a further external surface of revolution is provided co-axial with the internal surface and spaced radially therefrom to form therewith an annular passage, each of said surfaces being mounted for rotation on its axis relative to the other of said surfaces, and drive means adapted to rotate each surface at a different speed and/or in a different direction so that the assembly of fibres is rolled between said surfaces while being drawn through said passage.

9. Apparatus for spinning yarn comprising two coaxial members mounted for independent rotation on the common axis, drive means adapted to rotate said members at different rotational speeds, each member carrying a surface of rotation co-axial with the axis of rotation of the members, said surfaces of rotation being concentrically arranged to define therebetween an annular passage, one of said members carrying a radially inward open annular groove co-axial with said surfaces of revolution, said groove having the radially inner periphery of one wall thereof adjacent one axial end of the annular passage, and an axial bore in said one member spaced in the axial direction from the other end of the annular passage, means to deliver a stream of untwisted fibres into said annular groove, and means to withdraw a twisted yarn from said axial bore whereby a continuous assembly of fibres peeled from fibres in the annular groove and delivered to said one axial end of the annular passage may be simultaneously rolled between the surfaces of revolution while being drawn through the annular passage to form a twisted yarn.

10. A method of spinning yarn comprising collecting fibres in an internal annular recess in a member rotating about the axis of the annular recess, peeling continuously an assembly of fibres from said recess and drawing said assembly of fibres across a surface of revolution co-axial with the annular surface, and effecting movement between the assembly of fibres and said surface of revolution to cause the assembly of fibres to roll upon the surface of revolution whereby the fibres of the assembly are twisted together to form a yarn.

11. A method as claimed in claim 10 wherein the fibres are drawn across said surface of revolution through a passage formed by said surface of revolution and a further concentric surface of revolution spaced radially therefrom.

12. A method as claimed in claims 10 or 11 wherein said surface of revolution and said further surface of revolution are rotated at different rotational speeds and/or in different directions and the assembly of fibres is in rolling contact with both surfaces of revolution.

13. Apparatus for spinning yarn comprising a member mounted for rotation and having a fibre collecting annular recess in an internal face thereof co-axial with the axis of rotation, means to deliver fibres into said annular recess so that they are collected therein by the rotation of the member, a surface of revolution co-axial with the recess and displaced axially therefrom so that an assembly of fibres withdrawn from the annular recess may be drawn in the axial direction across said surface, and means to cause the assembly of fibres to roll on said surface of revolution while being drawn thereacross to twist the fibres together to form a yarn.

* * * * *